US012571065B2

(12) United States Patent
Ortolani et al.

(10) Patent No.: US 12,571,065 B2
(45) Date of Patent: Mar. 10, 2026

(54) METHOD OF MANUFACTURING HIGH STRENGTH STEEL TUBING FROM A STEEL COMPOSITION AND COMPONENTS THEREOF

(71) Applicant: TENARIS CONNECTIONS B.V., Amsterdam (NL)

(72) Inventors: Matteo Ortolani, Dalmine (IT); Jorge Torres Sebastian, Veracruz (MX); Alfonso Izquierdo Garcia, Veracruz (MX); Victor Blancas Garcia, Veracruz (MX); Erick Arturo Escorza Marquez, Dalmine (IT)

(73) Assignee: TENARIS CONNECTIONS B.V., Amsterdam (NL)

( * ) Notice: Subject to any disclaimer, the term of this patent is extended or adjusted under 35 U.S.C. 154(b) by 593 days.

(21) Appl. No.: 18/002,338

(22) PCT Filed: Jun. 23, 2021

(86) PCT No.: PCT/EP2021/067186
§ 371 (c)(1),
(2) Date: Dec. 19, 2022

(87) PCT Pub. No.: WO2021/260026
PCT Pub. Date: Dec. 30, 2021

(65) Prior Publication Data

US 2023/0357876 A1 Nov. 9, 2023

(30) Foreign Application Priority Data

Jun. 23, 2020 (NL) ..... 2025888

(51) Int. Cl.

| | |
|---|---|
| ***C21D 9/08*** | (2006.01) |
| ***C21D 1/30*** | (2006.01) |
| ***C21D 6/00*** | (2006.01) |
| ***C21D 8/10*** | (2006.01) |
| ***C21D 9/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/60*** | (2006.01) |

(52) U.S. Cl.

CPC ..... *C21D 9/085* (2013.01); *C21D 1/30* (2013.01); *C21D 6/004* (2013.01); *C21D 6/005* (2013.01); *C21D 6/008* (2013.01); *C21D 8/105* (2013.01); *C21D 9/14* (2013.01); *C22C 38/001* (2013.01); *C22C 38/002* (2013.01); *C22C 38/007* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 8,177,925 | B2 | 5/2012 | Takahashi et al. | |
| 9,394,579 | B2 | 7/2016 | Um et al. | |
| 10,077,490 | B2 | 9/2018 | Valls | |
| 2009/0238714 | A1* | 9/2009 | Arai | C21D 9/08 420/83 |
| 2013/0264123 | A1* | 10/2013 | Altschuler | C21D 1/30 148/519 |

OTHER PUBLICATIONS

ASTM International—Designation: A941-15; Standard Terminology Relating to Steel, Stainless Steel, Related Alloys, and Ferroalloys; Approved Nov. 1, 2015—Summary of Changes at end.
ASTM International—Designation: A576-25; Standard Specifcation for Steel Bars, Carbon, Hot-Wrought, Special Quality; Approved, May 1, 2025—Summary of Changes at end.

* cited by examiner

*Primary Examiner* — Jenny R Wu
(74) *Attorney, Agent, or Firm* — Morgan, Lewis & Bockius LLP

(57) ABSTRACT

A method of manufacturing tubing from a well-defined steel composition. in particular fat a suited gas inflator pressure vessel comprises the steps: a) producing a steel tubing from a steel composition including at least one hot rolling or hot forming pass: b) subjecting the steel tubing to a cold-drawing process to obtain desired dimensions. wherein the cold-drawing process comprises at least too pulls and before the first pull of the cold-drawn tug process an intermediate austenizing and quenching step: c) subsequently performing a final recovery heat treatment on the cold-drawn steel tubing at a temperature in the range of 200-600° C.

19 Claims, 1 Drawing Sheet

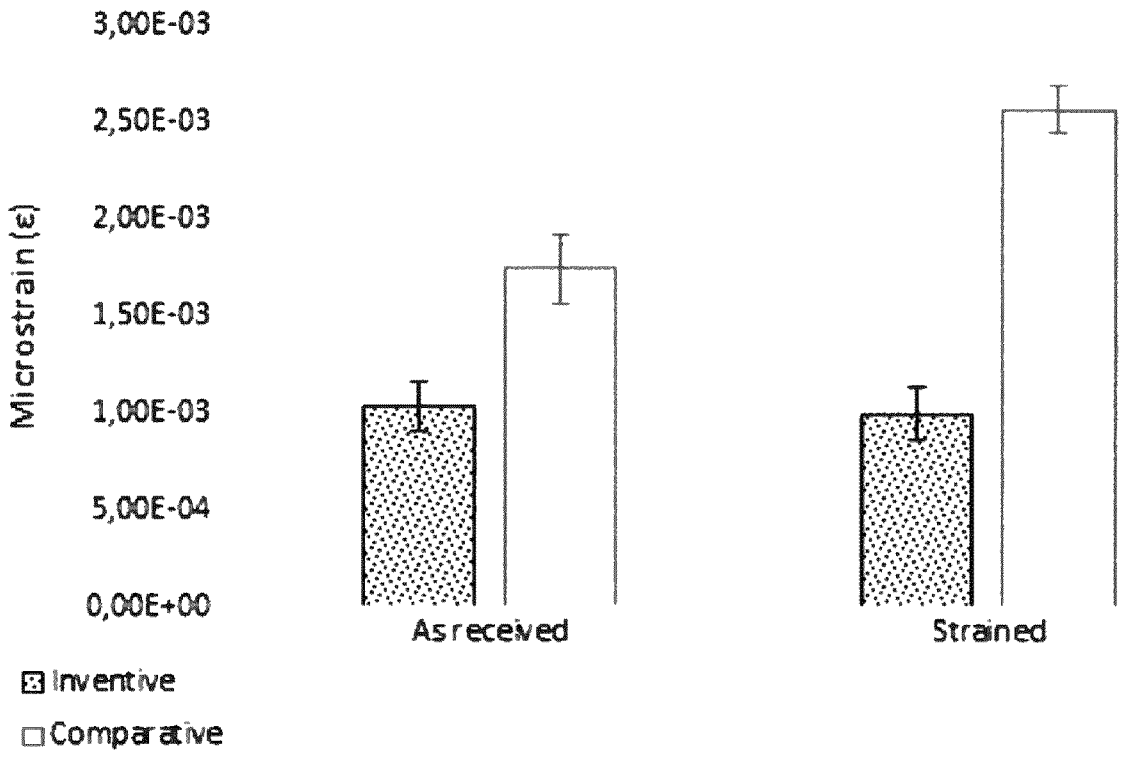
3,00E-03
2,50E-03
2,00E-03
1,50E-03
1,00E-03
5,00E-04
0,00E+00
Microstrain (ε)
As received
Strained
Inventive
Comparative

METHOD OF MANUFACTURING HIGH STRENGTH STEEL TUBING FROM A STEEL COMPOSITION AND COMPONENTS THEREOF

The present invention relates to a method of manufacturing high strength steel tubing from a steel composition, such as a micro-alloyed low carbon steel composition, as well as tubular components thereof. A steel tube manufactured according to the invention is particularly suitable for making components for automotive restraints systems, such as an automotive airbag inflator.

The automotive industry is continuously seeking to improve the efficiency of vehicles, wherein developing engines having an increased fuel efficiency and weight reduction in view of reducing fuel consumption plays an important role. Weight reduction can be achieved by parts having a reduced thickness, however without jeopardizing strength and safety requirements. Nowadays, Advanced High Strength Steels offer a high strength to density ratio, yet they require expensive alloying and manufacturing cycles. Thus, the industry is in continuous search for new high strength steel products at competitive cost, that achieve outstanding final properties.

The present invention concerns tubes and tubular components made from a steel composition having improved, or at least sufficient strength, ductility and toughness properties allowing such weight reduction, in particular for use as a tubular member of an airbag inflator. EP2078764A1 (Sumitomo Metal Industries Ltd.) has disclosed a seamless steel tube for an airbag accumulator. This steel tube can be manufactured by heat treatment of normalizing without quenching and tempering. The steel tube has a tensile strength of at least 850 MPa and resistance to bursting at −20° C. The composition of the steel tube comprises, in mass %, C: 0.08-0.20%, Si: 0.1-1.0%, Mn: 0.6-2.0%, P: at most 0.025%, S: at most 0.010%, Cr: 0.05-1.0%, Mo: 0.05-1.0%, Al: 0.002-0.10%, at least one of Ca: 0.0003-0.01%, Mg: 0.0003-0.01%, and REM (rare earth metals): 0.0003-0.01%, at least one of Ti: 0.002-0.1% and Nb: 0.002-0.1%, with Ceq (defined according to the formula Ceq=C+Si/24+Mn/6+(Cr+Mo)/5+(Ni+Cu)/15) being in the range of 0.45-0.63, The metallurgical structure is a mixed structure of ferrite and bainite.

WO2005/035800A1 (Lopez et al.) generally discloses a low carbon alloy steel tube and a method of manufacturing the same, in which the steel tube consists essentially of, in weight %, about 0.06-0.18% carbon; about 0.5-1.5% manganese; about 0.1%-0.5% silicon; up to about 0.015% sulfur; up to about 0.025% phosphorous; up to about 0.50% nickel; about 0.1 1.0% chromium; about 0.1-1.0% molybdenum; about 0.01%-0.10% vanadium; about 0.01 0.10% titanium; about 0.05-0.35% copper; about 0.010-0.050% aluminum; up to about 0.05% niobium; up to about 0.15% residual elements; and the balance being iron and incidental impurities. A manufacturing process for the steel tubing comprises the subsequent steps of steel making, steel casting, tube hot rolling, hot-rolled hollow finishing operations, cold drawing, heat treating comprising quenching and tempering after cold drawing and additional cold-drawn tube finishing operations. The resulting tube has a tensile strength of 1000 MPa or more and therefore a high burst strength.

WO2007/113642A2 (Lopez et al.) discloses a tube made from a similar low carbon alloy steel composition, as well as a modified manufacturing process thereof including—after cold drawing—a rapid induction austenizing/high speed quenching step, preferably without a tempering heat treatment.

Now it has been found that tubes manufactured according to these prior art processes of Lopez either possess strength at the expense of ductility or show ductility but at a lower strength level, in particular after tube finishing operations like straightening and cold working. It is a primary object of the invention to provide steel tubing having improved properties, in particular regarding the combination of strength and ductility, more specifically wherein the combination of strength and ductility properties is maintained or at least less affected upon performing finishing operations such as straining by straightening and cold forming the ends of the steel tubing.

Yet another object of the invention is to provide such a steel tubing from a weldable steel composition in view of manufacturing an automotive component typically including a welding step, such as a pressure vessel of an airbag inflator.

Still another object of the invention is to provide an alternative method for manufacturing a high strength steel tubing for use in an airbag inflator.

Now the present inventors have found that a novel manufacturing process of making steel tubing from a specific steel composition offers a favourable combination of strength and ductility properties.

SUMMARY OF THE INVENTION

FIG. 1 illustrates the average microstrain, before and after cold working, in one embodiment of the present invention (Example 4), as well as in a comparative steel composition (Example 5).

The method of manufacturing steel tubing from a steel composition according to the invention, in particular for an airbag inflator pressure vessel, is defined in claim 1.

The method comprises the steps of:

(a) producing steel tubing from a steel composition as described below including at least one hot rolling or hot forming pass;

(b) subjecting the steel tubing to a cold-drawing process to obtain desired dimensions, wherein the cold-drawing process comprises at least two pulls and before the final pull of the cold-drawing process an intermediate austenizing and quenching step;

(c) subsequent to the final pull of the cold-drawing process performing a final recovery heat treatment on the cold-drawn steel tubing at a temperature in the range of 200-600° C. In step b) of the method according to the invention the intermediate austenizing and quenching step, wherein the at least once cold-drawn steel tubing is heated to a temperature of at least Ac3 in order to promote a fine-grained microstructure, typically rapidly heating such as induction heating, in a timespan of seconds, and then quenched prior to the final pull ensures a mainly martensitic microstructure having sufficient strain hardening capability of the tubing being subjected to cold-drawing, and the subsequent cold-drawing pull or pulls applies/apply sufficient deformation for strain hardening, thereby achieving excellent strength properties.

The inventors have found that there is a significant difference in the sensitivity to strength and ductility properties between the tubular products of different manufacturing methods. A cold-drawn and then quenched tubular product (i.e. without further heat treatment or cold-drawing) achieves a high strength, but is subject to a significant loss of ductility upon straining. The tubular products after quenching are not used as such, but typically are subjected to further operations, in particular straightening and cold forming of edges thereby transforming the tubular products into fully finished articles, such as ready for assembling into automotive airbag inflators. Both operations involve a cold deformation after heat treatment, inducing a transformation in the microstructure of the steel tubular product, most notably by increasing the number of dislocations, resulting in an increase of the hardness, but simultaneously a decrease of the ductility and toughness. This embrittlement is aggravated by ageing, as shown by laboratory simulation at 250° C. for 1 hr (considered to be representative for ageing at room temperature for several months and beyond). Ageing promotes the accumulation of interstitial carbon (i.e. carbon in solid solution) at these dislocations, impairing further ductile deformation. The more carbon in solid solution, and the higher the dislocation density, the worse the embrittlement effect.

A cold-drawn, quenched and then tempered tubular product (i.e. without further cold-drawing) is less sensitive to loss of ductility after straining (and ageing) compared to the cold-drawn and then quenched tubular product, but has lower strength properties. The tempering treatment after quenching serves the purpose of restoring the ductility and toughness properties, to some extent, by promoting microstructural transformations such as precipitation of carbides and dislocations recovery, reducing the internal microstrains and therefore relieving internal stresses.

A cold-drawn, intermediately austenized and then quenched, cold-redrawn and recovered tubular product according to the invention achieves a higher strength compared to the cold-drawn, quenched and then tempered steel tubing and the level of ductility is less affected compared to the cold-drawn and then quenched tubular product, in particular after straining (straightening and cold forming, in particular of the ends). The recovery treatment after the final pull of the cold-drawing process in the range of 200-600° C., such as 300-600° C., is enough to ensure homogeneous precipitation of carbides. It serves to increase formability. Additionally, any heat treatment following recovery that is performed at a much lower temperature has thus a negligible effect on the microstructure. It is also assumed that in the invention the sensitivity to ageing is suppressed, which sensitivity is related to the diffusion of free interstitial elements (mainly carbon).

Thus compared to the cold-drawn and then quenched tubular product the tubular product produced according to the invention has similar high (or even higher) strength and good elongation properties, but is considerably less sensitive to loss of ductility as a result of straining. Compared to the cold-drawn, quenched and then tempered tubular product the tubular product produced according to the invention has a much higher strength and similar elongation properties at equivalent temperatures of the recovery treatment and temper treatment respectively. The higher strength properties allow to use tubular components having a smaller wall thickness and thus components having less weight in the end applications.

In the method according to the invention at least one cold-drawing pull is performed after the intermediate austenizing and quenching step. Preferably the total reduction of area of the one or more pulls after the intermediate austenizing and quenching step is at least 10%, preferably at least 15%, more preferably at least 20%, thereby ensuring sufficient strain hardening after the intermediate austenizing and quenching step. E.g. a total area reduction of 20% after the intermediate austenizing and quenching step can be achieved by a penultimate pull with an area reduction of 10% and a final pull with an area reduction of 11%. In a preferred embodiment, the intermediate austenizing and quenching step is carried out between the penultimate and final pull of the cold-drawing step b). Then advantageously the deformation, measured as the reduction of area, in the final pull of the cold-drawing process is at least 10%, preferably at least 15%, more preferably at least 20%.

Here it is noted that EP2650389A2 (Tenaris Connections B.V) has disclosed methods of manufacturing steel tubes and rods that can be used for mining and that aim at high abrasion resistance, high impact toughness while maintaining good dimensional tolerances. The steel composition in EP2650389A2 comprises about 0.18-0.32 wt. % carbon, about 0.3-1.6 wt. manganese, about 0.1-0.6 wt. % silicon, about 0.005-0.08 wt. % aluminum, about 0.2 1.5 wt. % chromium, about 0.2-1.0 wt. % molybdenum, and the balance comprises iron and impurities. The tube can be cold drawn in a first cold drawing operation to effect an area reduction of about 15%-30%, then heat treated to an austenizing temperature between about 50° C. above AC3 and less than about 150° C. above AC3, followed by quenching to about room temperature at a minimum of 20° C./second. The tube can then be cold drawn a second time to effect an area reduction of about 6%-14%. A second heat treatment can be performed by heating the tube to a temperature of about 400-600° C. for about 15-60 minutes to provide stress relief to the tube. The tube can then be cooled to about room temperature.

The steel composition used in the method according to the invention comprises, in wt. %, in addition to Fe and inevitable impurities, C: 0.04-0.15;
Mn: 0.90-1.60;
Si: 0.10-0.50;
Cr: 0.05-0.80;
Al 0.01-0.50;
N 0.0035-0.0150 and if desired, one or more optional elements as described below.

Hereinbelow the process steps of the method according to the invention are explained in more detail, as well as the composition.

Process

Step a) typically comprises the substeps of preparing the steel composition, casting the composition into a billet, piercing the billet at elevated temperature, and hot rolling the pierced billet in at least one hot rolling pass, optionally comprising an intermediate reheating step between two hot rolling passes to a temperature above Ac3.

For example, a starting product from a low carbon steel composition according to the invention, typically a solid steel bar or billet made by casting in the steel shop that can be pierced, is shaped into a hollow (seamless) length of tubing. The solid billet has e.g. a circular shape and its diameter is e.g. about 148 mm. Then the solid billet is heated and pierced, e.g. using the Mannesmann process, and subsequently hot rolled in one or more subsequent hot rolling passes in a hot rolling mill, during which the outside diameter and wall thickness are substantially reduced, while the length is substantially increased.

Advantageously the billet is heated to a temperature in the range of 1250-1300° C. During piercing the temperature difference is maintained at 50° C. or less. The rolling reduction is preferably 2 or more (RR≥2%) during piercing, e.g. the hollow billet once pierced has an outer diameter of 147 mm and a wall thickness of 13 mm. The cross-sectional area reduction, measured as the ratio of the cross-sectional area of the solid billet to the cross-sectional of the hot-rolled hollow tube, contributes to achieving a desired microstructure.

Hot rolling in step a) is performed in several passes. Advantageously the mandrel rolling temperature in a first pass is at least 1150° C. Also advantageously the rolling reduction in each pass, including the final one, is 3 or more (RR≥3%). Preferably the total minimum cross-sectional area reduction is 15% or more, more preferably 20% or more, and most preferably 25% or more. E.g. the hot rolled tube has an outer diameter of 42.4 mm and a wall thickness of 2.8 mm.

The hot rolling process may comprise an intermediate reheating step, wherein the hot-rolled intermediate product is reheated to a temperature above Ac3, such as 880° C. (being Ac3 of the composition described below) or higher.

After hot rolling the hot-rolled tubing is cooled to ambient temperature, advantageously in still air, at a suitable cooling rate that results in a mainly ferritic-bainitic microstructure while avoiding the generation of hard microconstituents. The intermediate tubing product thus obtained has an approximately uniform wall thickness over its length and its circumference. In the method according to the invention a normalizing treatment including austenization and slow (air) cooling may be carried out either in a furnace after hot rolling or the final hot rolling pass may be carried out as normalizing rolling (also known as normalizing forming). In normalizing rolling the final rolling temperature is above Ar3, preferably between Ar3 and the grain coarsening temperature, more preferably between Ar3 and 1050° C., and most preferably in the range of 850-1000° C. If the normalizing treatment is carried out in a furnace after hot rolling, the normalizing temperature is above Ac3, preferably between Ac3 and 1000° C. for a period of time allowing to complete the phase transformation, i.e. allowing the full section of tubing being heat treated to reach a temperature in this temperature range. The intermediate tubing product may be subjected to various finishing steps, for example straightening, end cropping, cutting to a desired length and non-destructive testing.

In preparation for the subsequent cold drawing process the surface of the tube cut to length is properly conditioned. Typical conditioning steps include pickling e.g. immersion in an acid solution, applying one or more layers of one or more lubricants such as a combination of zinc phosphate and sodium stearate or a reactive oil.

The tube having an appropriately conditioned surface is subsequently subjected to a cold-drawing process comprising at least two passes, wherein during each pass the outside diameter and the wall thickness of the tube are further reduced. According to the invention the cold-drawing process includes an intermediate austenizing and quenching step before the final pass of the cold-drawing process. This intermediate austenizing and quenching step between the cold-draw pulls comprises (rapid) heating to above Ac3 as explained above, advantageously by induction heating, of the at least once cold-drawn tube and rapid cooling, advantageously by water quenching, preferably at a rate of at least 50° C./s, typically measured between 800° C. and 500° C., continuing forced cooling until reaching a temperature below the martensite start (Ms) temperature, preferably below 100° C. or below, and more preferably below 50° C., thereby achieving a transformation producing a hard martensitic microstructure. As already mentioned, preferably the total reduction of area after the intermediate austenizing and quenching step is at least 10%, preferably at least 15%, more preferably at least 20%. In a preferred embodiment the reduction of area in the last pull is at least 10% (RA≥10%). Advantageously the intermediate austenizing and quenching step is carried out between the penultimate and last cold draw pull. The final dimensions of the cold-drawn tube are for example in the range of 20-60 mm for the outer diameter and in the range of 1-4 mm for the wall thickness.

Before the austenizing and quenching step an intermediate normalizing treatment may be incorporated in the cold-drawing process.

After cold drawing a final recovery heat treatment is carried out in the range of 200-600° C., such as 300-600° C. in order to reduce internal stresses and density of dislocations, and to stabilize the microstructure. In the final recovery heat treatment the steel tubing is stress relieved at a temperature in the above range, at which temperature the yield strength is sufficiently lower than at ambient temperature and the steel material is recovered by promoting the precipitation of fine carbides. The latter requiring a minimum temperature of at least 200° C. to ensure transformation of residual austenite. If the final recovery heat treatment temperature is higher than 600° C., undesired recrystallization of martensite might occur. The intermediate austenization and quenching step has produced a martensitic microstructure (single phase steel), wherein the carbon is present in supersaturated solid solution. During the final recovery heat treatment carbon combines with iron and any other carbide forming alloying elements such as chromium and molybdenum and precipitates as carbide. These carbides stabilize the microstructure. These carbides are also assumed to minimize embrittlement caused by strain ageing. Without being bound to any theory, it is believed that upon ageing, large amounts of carbon in solid solution, for example in untempered material such as the cold-drawn and then quenched steel mentioned above, produce very strong Cottrel atmospheres around dislocations, which atmospheres impair movement of the dislocations, resulting in an embrittled material. By reducing the dislocation density and promoting the precipitation of carbides as a result of the final recovery heat treatment according to the invention, this disadvantageous phenomenon is assumed not to occur, or at the very least considerably reduced. Thus embrittlement due to strain ageing could be reduced as well.

After recovery the tubular component as manufactured according to the invention typically is subjected to finishing operations, like straightening and forming of ends. Thus in an embodiment the method further comprises a cold forming step e) of cold forming the tubular product from step c), in particular the ends thereof, optionally preceded by a straightening step d) of straightening the recovered tubular product from step c). It has been found that upon application of this kind of straining the tensile strength remains at the same level or slightly increases and the ductility value is less affected and remains higher compared to the cold-drawn and then quenched tubular product. A cold-drawn, quenched and then tempered steel tubing shows a similar increase in strength upon straining, although at a lower strength level and to a lesser extent as the cold-drawn and then quenched tubular product.

Composition

The steel composition used in the method according to the invention preferably comprises, in wt. %, in addition to Fe and inevitable impurities, C: 0.04-0.15;
Mn: 0.90-1.60;
Si: 0.10-0.50;
Cr: 0.05-0.80;

Al 0.01-0.50;

N 0.0035-0.0150.

Preferably the composition comprises one or more carbide-, nitride- or carbonitride-forming elements in an amount sufficient to bind N in the form of (carbo)nitrides. Examples of these elements include V, Ti and Nb, in addition to Al. Preferably these elements satisfy the equation [% AI]/1.9+[% Ti]/3.4+[% V]/3.6+[% Nb]/6.6≥[% N], wherein % is wt. %. Ageing is related to the diffusion of interstitial elements, mainly carbon, but also diffusion of nitrogen plays a role in ageing. The above formula ensures that residual nitrogen is bound in the form of nitrides.

Additionally the composition may comprise the optional elements, in wt. %,

Mo: 0-0.50;

Ni: 0-0.50;

Cu 0-0.25;

V 0-0.40;

Nb 0-0.20;

Ti 0-0.10;

B 0-0.005.

Ca 0-0.005.

If present, the amounts of the inevitable impurities are

As 0-0.05;

Sb 0-0.05;

Sn 0-0.05;

Pb 0-0.05;

Bi 0-0.005;

S 0-0.015;

P 0-0.025.

The remainder in the composition is iron (Fe).

Advantageously

[% Sn]+[% Sb]+[% Pb]+[% As]+[% Bi]≤0.10%;

and/or $0.3 \leq Ceq \leq 0.7$, wherein $$Ceq=[\%\ C]+[\%\ Mn]/6+{}_{([\%\ Cr]+[\%\ Mo]+[\%\ V])}5+([\%\ Ni]+[\%\ Cu])/15,$$

and/or

[% Al]/1.9+[% Ti]/3.4+[% V]/3.6+[% Nb]/6.6≥[% N], wherein [%] is wt. %. Preferably the steel composition meets all three equations.

The steel composition, preferably a low carbon steel composition in view of weldability, and preferably a (microalloyed) steel composition comprises one or more carbide-, nitride- or carbonitride-forming elements, ensuring that N is bound in the form of (carbo)nitrides in order to exploit the (carbo)nitride effect on grain refinement, as explained above.

This composition is very lean regarding alloying elements, in particular it does not require a minimum amount of molybdenum and/or vanadium. The composition ensures a minimum N content in relation to nitride forming elements such as Al, Nb, Ti and V in order to allow sufficient (carbo-)nitrides being present during austenization for improved grain size control. Regarding the individual elements in the low carbon micro-alloyed composition the following explanation is presented. The ranges in brackets are preferred ranges and present a balance between costs and beneficial effects on structure, process and/or properties.

Carbon (C): 0.04-0.15 (0.06-0.12)

C is required to strengthen the steel by means of precipitation of very fine carbides in the last stage of transformation; however, an excessive amount of carbon produces a large increase in internal stresses upon quenching, which in turn renders welding impractical or outright not possible. Therefore the C content is 0.04-0.15, preferably 0.06-0.12.

Manganese (MN): 0.90-1.60 (1.00-1.40)

Mn is an important alloying element, with different functions. Upon cooling of austenite, it lowers the transformation temperature of austenite into ferrite: therefore, upon normalizing, it increases the rate of nucleation versus growth, and eventually results in refined grain size. Upon quenching instead, Mn increases the hardenability of the material, ensuring obtaining a fully martensitic structure over larger sections. However, excessive amounts of Mn may result in undesirably high amounts of retained austenite after quenching. Additionally, Mn is known to reduce intergranular fracture strength, and therefore excessive amounts affect impact toughness. Therefore the Mn content is 0.90-1.60, preferably 1.00-1.40.

Silicon (SI): 0.10-0.50 (0.20-0.35)

Si is present for deoxidizing the steel. However, large amounts have an adverse effect on toughness. In addition, Si increases the sensitivity to temper embrittlement by enhancing segregation of P at grain boundaries. Therefore the Si content is 0.10-0.50, preferably 0.20 0.35.

Chromium (CR): 0.05-0.80 (0.30-0.60)

Cr is effective in increasing the hardenability of the steel, and, as a carbide former, allows the formation of bainite upon continuous cooling. Very high amounts of Cr diminish in effectiveness on hardening, and increase the cost of steelmaking unnecessarily. Therefore the Cr content is 0.05-0.80, preferably 0.30-0.60.

Aluminium (AL): 0.01-0.50 (0.015-0.030)

Al is a deoxidizing element and a nitride former. A minimum amount is required to ensure sufficient deoxidation, and allows to bind residual nitrogen. Excessive amounts may result in large non-metallic inclusions. Therefore the Al content is 0.01-0.50, preferably 0.015-0.030.

Nitrogen (N): 0.0035-0.0150 (0.006-0.010)

N is, in one aspect, an inevitable residual element in steelmaking. However, small amounts are in fact desirable because N can be exploited for controlling grain size by promoting the precipitation of nitrides with (carbo-)nitride forming elements, for example, Al, Ti, Nb or V. A minimum content is therefore required for grain size control. On the other hand, free N (in interstitial solid solution) needs to be avoided, because it increases the effect in ageing and promotes the formation of Luders bands, eventually reducing the cold formability of the product. Therefore the N content is 0.0035-0.0150, preferably 0.006-0.010. The available combined amount of Al, Ti, Nb and V needs to be sufficient to bind any residual N according to the stoichiometric formula MAIV1.9+[% Ti]/3.4+[% V]/3.6+[% Nb]/6.6≥[% N], preferably [icAl]/1.9+[% Ti]/3.4+[%1/]/3.6+[% Nb]/6.6≥1.1 [% N], wherein [%] is wt. %.

Molybdenum (MO): 0-0.50 (0.10-0.20)

Mo is very effective in increasing the hardenability of the steel, and as a strong carbide former, Mo allows the formation of bainite upon continuous cooling. Additionally, Mo enhances the resistance to tempering, allowing to maintain a desirable strength level while improving toughness and reducing internal stresses. Large amounts of Mo are not desirable due to cost, but also because Mo lowers the martensite transformation temperatures, and may result in larger amounts of retained austenite upon quenching. Therefore the Mo content is 0-0.50, preferably 0.10-0.20

Nickel (NI): 0-0.50 (0-0.20)

Ni is an austenite stabilizer, which allows refining the ferrite grain size thanks to lowering the transformation temperature in a manner akin to Mn. Ni additionally improves toughness. However, Ni can increase the amount of retained austenite upon quenching, and therefore needs to be limited. Additionally, Ni is often expensive and similar effects may be obtained otherwise. Therefore the Ni content is 0-0.50, preferably 0-0.20.

Copper (CU): 0-0.25 (0-0.20)

Cu slightly improves hardenability and is inevitably found in scrap steel. However, large amounts of Cu may produce hot shortness; this decreases the surface quality (increases roughness) of hot finished products, but may also result in serious and unrepairable defectiveness. Therefore the Cu content is limited to 0-0.25, preferably 0-0.20.

Vanadium (V): 0-0.40 (0-0.10)

V is a strong carbide and nitride former, and is present for increasing hardenability, achieve precipitation hardening, and refining the austenite grain size. Its effectiveness as refining element is limited by its solubility in austenite at higher temperatures. Therefore the V content is 0-0.20, preferably 0-0.10.

Niobium (Nb): 0-0.20 (0-0.05) and titanium (Ti): 0-0.10 (0-0.05) are both strong carbide and nitride formers. Their role is similar to V in controlling austenite grain size, and are more effective than the former thanks to their low solubility in austenite. Titanium is more effective than Nb at higher temperatures (above about 1100° C.), whereas Nb generally results in a finer dispersion of precipitates and therefore allows achieving the finest prior austenitic grain size.

Tin (Sn): 0-0.05 (0-0.03), antimony (Sb): 0-0.05 (0-0.01), arsenic (As): 0-0.05 (0-0.03), lead (Pb): 0-0.05 (0-0.01) and bismuth (Bi): 0-0.005.

These inevitable impurities negatively affect the toughness of the steel. Therefore their contents are limited. Advantageously [% Sn]+[% Sb]+[% Pb]+[% As]+[% Bi]≤0.10%, wherein [%] is wt. %.

Phosphorous (P): 0-0.025, preferably 0-0.02, sulphur (S): 0-0.015, preferably 0-0.005. P and S are also inevitable elements and their contents are limited as explained below.

Calcium (Ca) 0-0.005; REM: 0-0.005.

Ca and rare earth metals (REM) may be used in inclusion control. Ca and REM form complex oxides with Al and Mg. These complex oxides have a lower melting point. They promote flotation, resulting in a reduction of the inclusion content. Additionally, the shape of retained non-metallic inclusions becomes spheroidized, reducing their embrittling effect. While most Ca, Mg remain in the so-formed slag, a residual amount of Ca is inevitable in the steel after treatment.

Boron (B) 0-0.005 (0-0.0005)

B increases hardenability up to about 0.0020% (depending on actual carbon content). Boron also may negatively affect toughness by promoting the formation of boron nitrides, whose precipitation is only suppressed by the action of Ti in excess of about 3.4×N. Intentional addition of B is not strictly required to achieve the desired hardenability; moreover, especially in absence of Ti additions, B content should be limited to ensure optimal toughness.

Limits are advantageously also imposed on the hardenability measured in terms of Carbon equivalent (IIW formula): 0.3≤Ceq≤0.7, wherein $$Ceq=[\%\ C]+[\%\ Mn]/6+([\%\ Cr]+[\%\ Mo]+[\%\ V])/5+([\%\ Ni]+[\%\ Cu])/15,\ \text{wherein [\%] is wt. \%.}$$

Steel-Making Process and Inclusion Content

Typically the steel-making process is carried out using clean practice conditions in order to achieve the very low sulphur and phosphorous content. The low content of S and P is significant for achieving the mechanical properties, in particular ductility and toughness. The steel is produced according to a clean practice, ensuring a very low amount of nonmetallic inclusions. In view thereof advantageously an inclusion level according to ASTM E45 Standard-Worst Field Method (Method A) is applied:

| Inclusion Type | Thin | Heavy |
|---|---|---|
| A | 0.5 | 1 |
| B | 1.5 | 1 |
| C | 0 | 0 |
| D | 1.5 | 0.5 |

Additionally, the clean practice allows obtaining oversize inclusion content with 30 pm or less in size. In view thereof the total oxygen content is limited to 20 ppm.

As an example of extreme clean practice in secondary metallurgy bubbling inert gases in the ladle furnace is mentioned. The bubbled gasses force the non-metallic inclusions and impurities to float on the liquid steel. Producing a fluid slag that is capable of absorbing these inclusions and impurities, as well as the addition of silicon and calcium to the liquid steel for modifying the size and shape modification of the inclusions contribute to preparing a micro-alloyed low carbon steel having the desired low inclusion content.

Microstructure

The hollow after the optional normalizing treatment as described above preferably has a fine-grained microstructure, that is composed of ferrite (polygonal, acicular and/or Wiedmanstattern), bainite, preferably >20 (area) % bainite, and pearlite, preferably <5%. The microstructure is homogeneous to reduce inevitable segregation of residual elements from the casting process. The hollow has good strain hardening capability for ensuring the quality, in particular the mechanical properties, of the cold drawn tube.

The intermediate austenizing and quenching step as part of the method according to the invention, that is carried out before the final cold draw pull in the multi pass cold-drawing process, transforms the microstructure of the hot-rolled tube that is subjected to cold-drawing, to a mainly martensitic structure, that is composed of martensite with minor amounts of bainite, preferably equal to or less than 20% bainite, and ferrite, preferably equal to or less than 5%.

The final microstructure, achieved by the final recovery heat treatment after cold-drawing, comprises 80% or more of strain hardened and recovered martensite and lower bainite, with minor amounts of coarse bainite and ferrite, preferably coarse bainite and ferrite in amounts as low as possible. Preferably the microstructure comprises 90% martensite and lower bainite (determined by hardness (HRC) >27+58×[% C] measured after quenching and before further cold-drawing), more preferably 95% or more martensite and lower bainite (determined by hardness (HRC) (HRC)>29+59×[% C] measured after quenching and before further cold-drawing).

Advantageously the grain size number (ASTM E112) of the final microstructure is 9 or higher, preferably 10 or higher. The higher the grain size number, the finer the microstructure.

Properties

The method according to the invention allows to manufacture tubular products having one or more of the following mechanical properties:

yield strength (YS): ≥896 MPa (130 ksi);

tensile strength (TS): ≥1103 MPa (160 ksi);

total elongation (A 5D): ≥9%;

DBTT: ≤−60° C.;

Burst: predominantly (≥50%) ductile at −60° C.

The yield strength, tensile strength and elongation are determined according to ASTM E8. The burst test was performed by sealing the ends of the tube, e.g. by welding flat steel plates or flanges to the ends of the tube. Then an internal pressure is applied to the tube using a suitable fluid until the tube fails. The test may be performed at the desired temperature in a thermo-regulated chamber, or by regulating the fluid temperature.

Advantageously the resulting product has a combination of at least two of the above properties, more preferably all above properties.

EXAMPLES

Micro-alloyed steel compositions as listed in Table 1 were prepared under clean practice and casted into a round billet having a diameter of about 148 mm. This billet was subjected to a process comprising the steps of induction heating to a temperature of 870° C., i.e. above Ac3, piercing, hot-rolling using floating mandrel technology with intermediate reheating and final stretch reducing rolling, cooling and furnace normalizing.

TABLE 1

| | Chemical composition | | | | |
|---|---|---|---|---|---|
| Composition | A | B | C | D | E |
| C | 0.1 | 0.09 | 0.11 | 0.1 | 0.1 |
| Mn | 1.34 | 1.27 | 1.27 | 1.28 | 1.3 |
| Si | 0.26 | 0.24 | 0.25 | 0.29 | 0.25 |
| P | 0.014 | 0.011 | 0.014 | 0.015 | 0.011 |
| S | 0.002 | 0.0013 | 0.001 | 0.001 | 0.001 |
| Cr | 0.61 | 0.36 | 0.61 | 0.43 | 0.44 |
| Mo | 0.18 | 0.15 | 0.17 | 0.14 | 0.14 |
| Ni | 0.11 | 0.07 | 0.15 | 0.14 | 0.12 |
| Cu | 0.15 | 0.14 | 0.17 | 0.17 | 0.21 |
| V | 0.1 | 0.063 | 0.1 | 0.06 | 0.06 |
| Nb | 0.002 | 0 | 0.001 | 0.002 | 0.002 |
| Al | 0.028 | 0.031 | 0.036 | 0.028 | 0.029 |
| Ti | 0.023 | 0 | 0.014 | 0.003 | 0.002 |
| N | 0.0091 | 0.0058 | 0.007 | 0.0088 | 0.0078 |
| B | 0.0004 | 0.0002 | 0.0002 | 0.0002 | 0.0005 |
| As | 0.007 | 0.004 | 0.006 | 0.006 | 0.008 |
| Sb | 0.002 | 0 | 0.0004 | 0.0015 | 0.0017 |
| Sn | | 0.01 | 0.011 | 0.016 | 0.016 |
| Pb | 0.0006 | 0.0006 | 0.0004 | 0.0001 | 0.0001 |
| Bi | 0.0002 | 0.0002 | 0.0002 | 0.0004 | 0.0005 |
| Ca | 0.0014 | 0.0011 | 0.0013 | 0.0012 | 0.0011 |
| Al/1.9 + Ti/3.4 + V13.6 + Nb/6.6 | 0.0496 | 0.0338 | 0.0510 | 0.0326 | 0.0328 |
| Ceq | 0.52 | 0.43 | 0.52 | 0.46 | 0.47 |
| Pcm | | 0.2 | 0.25 | 0.22 | 0.23 |

Example 1 (Comparative)

The hot-rolled hollow thus obtained from composition A having an outer diameter (OD) of 42.4 mm and a wall thickness (VVT) of 2.9 mm was cold drawn in two pulls to a size of 30*1.85 mm (OD*WT), heat treated in the range of 900-1030° C. and quenched using a water spray. The tubular product thus obtained was subjected to straining simulated by cold f (mandrel-free cold-drawing) to an OD of 25 mm in order to simulate the effect of finishing forming operations. A recovery treatment was not applied.

Example 2 (Comparative)

In another example the same composition A was also used for manufacturing a tube according to a similar process under the same conditions, except that a quench and temper heat treatment was performed at 400° C. before the simulation of straining (mandrel-free cold-drawing).

The below table 2 lists the properties as measured using the respective standards ASTM E8 and ASTM E10, for the products as obtained ("as received") in these Examples prior to the simulation and for the products after cold-working, that simulates straightening and straining ("strained").

TABLE 2

| | Example 1 | | Example 2 | |
|---|---|---|---|---|
| | HT (as received) | CD (strained) | HT (as received) | CD (strained) |
| Properties TS in MPa (ksi) | 1303 (189) | 1441 (209) | 1158 (168) | 1199 (174) |
| YS in MPa (ksi) | 1013 (147) | 1172 (170) | 1061 (154) | 1034 (150) |
| A 5D in % | 14 | 8 | 13 | 10 |
| Strain hardening K in MPa (ksi) | 1868 (271) | | 1516 (220) | |
| n | 0.11 | | 0.07 | |
| Hardness HV 10 | 429 | 449 | 387 | 379 |
| Burst pressure in bar (psi) | 1813 (26, 298) | 2469 (35, 810) | 1732 (25, 130) | 2146 (31, 126) |

From comparison of these examples it appears that Example 1 (drawn-quenched-redrawn) outperforms Example 2 (drawn-quenched and tempered-redrawn) in almost every aspect, except for the decrease in elongation (A 5D).

Example 3 (Invention)

A tubular product was made from steel composition B according to the process outlined for Example 1, however with the incorporation of an intermediate austenizing and quenching treatment prior to the final cold drawing pull and the incorporation of a final recovery heat treatment at 430° C. after the final cold drawing. Austenizing was carried out by induction heating to 950° C. and a soaking time of 5 seconds, followed by quenching to room temperature using an external water spray (cooling rate over 50° C./s). After hot rolling the hollow measured 48.3*3.4 mm (OD*VVT). The final size of the cold-drawn product was 35*2 mm.

The obtained product had the following metallurgical and mechanical properties:

UTS: 1248 MPa (182 ksi);

YS: 1228 MPa (178 ksi);

Total elongation: 10%;

Grain size number (ASTM E112): 13;

Hardness HVio: 394;

Burst at ambient temperature: 1731-1738 bar (25.1-25.2 ksi);

Burst fracture appearance at −69° C.: >50% shear area.

Example 4 (Invention)

A tubular product was made from steel composition C according to the process outlined in Example 1, however again with the incorporation of an intermediate austenizing and quenching treatment prior to the final cold drawing pull and the incorporation of a final recovery heat treatment at 400° C. after the final cold drawing. Austenizing was carried out by induction heating to 900-1030° C., followed by quenching to room temperature using an external water spray (cooling rate over 50° C./s). After hot rolling the hollow measured 38.0*2.9 mm. At a reduction of 29% in the first cold drawing pull the hollow measured 34.5*2.25 mm. After the second cold drawing pull at a reduction of 26% the final size of the cold-drawn product was 30*1.92 mm.

The product thus obtained had the following metallurgical and mechanical properties:

UTS: 1262 MPa (183 ksi);

YS: 1172 MPa (170 ksi);

Total elongation: 16.8%;

Grain size number (ASTM E112): 11-12;

Hardness HVio: 428;

Burst at ambient temperature: average 1972 bar (28.6 ksi);

Burst fracture appearance at −60° C.: >50% shear area.

Example 5 (Comparative)

Example 1 was repeated using steel composition D, except that the cold drawing involved a single pull, after which the quenching step was performed. After hot rolling the hollow measured 38.1*2.7 mm. The hollow after the single cold drawing step at reduction of 32% had dimensions of 33.2*2.08 mm.

The product had the following metallurgical and mechanical properties:

UTS: 1277 MPa (183 ksi);

YS: 992 MPa (170 ksi);

Total elongation: 15%;

Grain size number (ASTM E112): 11-12; Hardness HVio: 413;

Example 6 (Comparative)

Example 2 was repeated using steel composition E, except that cold drawing involved a single pull, after which quenching and tempering at 380° C. was performed. After hot rolling the hollow measured 38.1*2.7 mm. The hollow after the single cold drawing step at reduction of 33% had dimensions of 32*2.15 mm.

The product had the following metallurgical and mechanical properties:

UTS: 1084 MPa (183 ksi);

YS: 911 MPa (170 ksi);

Total elongation: 13%;

Grain size number (ASTM E112): 11-12;

Hardness HVio: N.A.

The tubular products from Examples 4-6 were subjected to straining simulated by cold forming (mandrel-free cold drawing) at an area reduction of 17%. The below Table 3 summarizes the results, wherein "as-received" indicates the tubular products manufactured according to these Examples and "strained" the tubular products after the simulated straining.

TABLE 3

| | EXPERIMENTAL DATA EXAMPLES 4-6 | | | | | |
|---|---|---|---|---|---|---|
| | Ex. 4 | | Ex. 5 | | Ex 6 | |
| Property | As received | Strained | As received | Strained | As received | Strained |
| Rm in MPa (ksi) | 1262 (183) | 1310 (190) | 1277 (185) | 1358 (197) | 1084 (157) | 1110 (161) |
| A5 D in % | 16.8 | 6.3 | 15 | 4.3 | 13 | 5 |

From this table it appears that upon straining the tensile strength of the Example 4 according to the invention is higher than that of Example 6. This also applies to the elongation. Although the strength of Example 5 is higher than that of Example 4, the elongation value of Example 4 according to the invention, for both the as-received tubular product and the strained product, is higher. Thus the favourable combination of strength and ductility properties of the product manufactured according to the invention remains upon cold working allowing to finish the product properly.

Furthermore it has been found that the dislocation density in Example 4 according to the invention is significantly lower than that of Example 5 as is apparent from FIG. 1, that shows the average microstrain £ (note that dislocation density p is proportional to $£^2$ (p=A*(0) with A being a material's constant)). As can be seen in the invention the dislocation density is much lower than in the embodiment of Example 5. Moreover, upon cold working (=straining) the dislocation density in the invention remains almost the same, while the material of Example 5 showed a significant increase in microstraining and thus dislocation density. An increase in dislocation density increases the hardness and strength, but decreases the ductility and toughness properties, it can be assumed that straining affects the steel tubing according to the invention regarding strength and elongation and thus formability to a lesser extent than the material of Example 5.

Airbag Inflator Pressure Vessel

A seamless tube manufactured according to the invention is cut to length and then cold formed using known techniques, e.g. crimping, swaging and the like, into a desired shape. As an alternatively, a welded tube processed according to the invention, could be used. To each end of cold formed tube an end cap and a diffuser are welded using known techniques, e.g. friction welding, arc welding and laser welding, thereby producing the airbag inflator pressure vessel.

The invention claimed is:

1. A method of manufacturing tubing from a steel composition, in particular for a stored gas inflator pressure vessel, comprising:

a) producing a steel tubing from a steel composition including at least one hot rolling or hot forming pass;

b) subjecting the steel tubing to a cold-drawing process to obtain desired dimensions, wherein the cold-drawing process comprises at least two pulls and before the final pull of the cold-drawing process an intermediate austenizing and quenching step; and c) subsequent to the final pull of the cold-drawing process performing a final recovery heat treatment on the cold-drawn steel tubing at a temperature in the range of 200-600° C.

wherein the steel composition comprises, in wt. %,

C: 0.04-0.15;

Mn: 0.90-1.60;

Si: 0.10-0.50;
Cr: 0.05-0.80;
Al 0.01-0.50;
N 0.0035-0.0150;
Mo: 0-0.50;
Ni: 0-0.50;
Cu 0-0.25;
V 0-0.40;
Nb 0-0.20;
Ti 0-0.10;
B 0-0.005;
Ca 0-0.005,
As 0-0.05;
Sb 0-0.05;
Sn 0-0.05;
Pb 0-0.05,
Bi 0-0.005;
S 0-0.015;
P 0-0.025;
the remainder being Fe and other inevitable impurities.

2. The method according to claim 1, wherein the total reduction of area of the final pull of the cold-drawing process is at least 10%.

3. The method according to claim 1, wherein the intermediate austenizing and quenching step is carried out between the penultimate and final pull of the cold-drawing process.

4. The method according to claim 1, wherein in the intermediate austenizing and quenching step comprises quenching at a quenching rate of at least 50° C./s.

5. The method according to claim 1, wherein the step a) of producing a steel tubing comprises the substeps of preparing the steel composition, casting the composition into a billet, piercing the billet at elevated temperature, and hot rolling the pierced billet in at least one hot rolling pass.

6. The method according to claim 1, wherein the rolling reduction in each hot rolling pass is at least 3%.

7. The method according to claim 1, wherein in step b) the intermediate austenizing and quenching step comprises heating to a temperature above Ac3.

8. The method according to claim 1, wherein the method further comprises a normalizing heat treatment, which comprises either heat treating the hot rolled tubing at a temperature above Ac3 after hot rolling or normalizing rolling in the final hot rolling pass at a temperature above Ar3.

9. The method according to claim 8, wherein the normalizing heat treatment comprises heat treating the hot rolled tubing at a temperature between Ac3 and 1000° C. after hot rolling.

10. The method according to claim 8, wherein the normalizing heat treatment comprises normalizing rolling in the final hot rolling pass at a temperature between Ar3 and a grain coarsening temperature.

11. The method according to claim 1, further comprising a cold forming step d) of cold forming the cold-drawn steel tubing from step c), in particular ends thereof.

12. The method according to claim 1, wherein [% Sn]+[% Sb]+[% Pb]+[% As]+[% Bi]≤0.10%, wherein [%] is wt. %.

13. The method according to claim 1, wherein $$0.3 \leq Ceq \leq 0.7, \text{ wherein}$$

$$Ceq=[\%\ C]+[\%\ Mn]/6+([\%\ Cr]+[\%\ Mo]+[\%\ V])/5+([\%\ Ni]+[\%\ Cu])/15,$$

or

[% Al]/1.9+[% Ti/3.4]+[% V]/3.6+[% Nb]/6.6≥[% N], wherein [%] is wt. %.

14. The method according to claim 1, wherein in the steel composition, in wt. %, C: 0.06-0.12;
Mn: 1.00-1.40;
Si: 0.20-0.35;
Cr: 0.30-0.60;
Al 0.015-0.030;
N 0.006-0.010.

15. The method according to claim 1, wherein [% Al]/1.9+[% Ti]/3.4+[% V]/3.6+[% Nb]/6.6≥1.1 [% N], wherein [%] is wt. %.

16. The method according to claim 1, wherein the resulting tubing has one or more of the properties:

yield strength (YS): ≥896 MPa (130 ksi);
tensile strength (TS): ≥1103 MPa (160 ksi);
total elongation (A 5D): ≥9%;
wherein YS, TS and A 5D are determined according to ASTM E8
DBTT: ≤−60° C.;
Burst: >50% ducile at −60° C.

17. The method according to claim 1, wherein the resulting tubing has a mainly martensitic microstructure comprising 80% or more martensite and lower bainite, the remainder being coarse bainite and ferrite.

18. The method according to claim 1, wherein the grain size number (ASTM E112), in the resulting tubing is 9 or higher.

19. An automotive component, in particular an airbag inflator pressure vessel, comprising a length of tubing manufactured according to claim 1.

* * * * *